US009995523B2

(12) United States Patent
Park et al.

(10) Patent No.: US 9,995,523 B2
(45) Date of Patent: Jun. 12, 2018

(54) REFRIGERATOR WITH ICEMAKER AND METHOD OF OPERATING BASED ON A VARIATION IN THE AMOUNT OF STORED ICE

(71) Applicant: LG Electronics Inc., Seoul (KR)

(72) Inventors: Junsoo Park, Seoul (KR); Jiyeong Ku, Seoul (KR); Jiyoon Lee, Seoul (KR); Jiyoung Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 323 days.

(21) Appl. No.: 15/006,360

(22) Filed: Jan. 26, 2016

(65) Prior Publication Data

US 2016/0216022 A1 Jul. 28, 2016

(30) Foreign Application Priority Data

Jan. 26, 2015 (KR) ..... 10-2015-0012233

(51) Int. Cl.

*F25C 5/18* (2018.01)
*F25C 5/16* (2006.01)
*F25C 5/00* (2018.01)

(52) U.S. Cl.

CPC ..... *F25C 5/16* (2013.01); *F25C 5/00* (2013.01); *F25C 5/187* (2013.01); *F25C 5/24* (2018.01); *F25C 5/22* (2018.01); *F25C 2600/04* (2013.01); *F25C 2700/02* (2013.01)

(58) Field of Classification Search

CPC .... F25C 5/00; F25C 5/187; F25C 5/20; F25C 5/22; F25C 5/24; F25C 2300/00; F25C 2600/02; F25C 2600/04; F25C 2700/02; F25C 2700/12

See application file for complete search history.

(56) References Cited

U.S. PATENT DOCUMENTS 5,619,858 A * 4/1997 Gunderson ..... F25C 5/187 62/137
2008/0134709 A1 6/2008 Fischer et al.
2014/0165643 A1* 6/2014 Boarman ..... F25C 1/10 62/340

FOREIGN PATENT DOCUMENTS

| | | |
|---|---|---|
| JP | 2006-176132 | 7/2006 |
| JP | 2011-158185 | 8/2011 |
| KR | 10-2005-0041753 | 5/2005 |
| KR | 10-2012-0060772 | 6/2012 |
| KR | 10-2014-0113085 | 9/2014 |

OTHER PUBLICATIONS

Office Action issued in Korean Application No. 10-2015-0012233 dated Jan. 7, 2016, 6 pages.
Extended European Search Report issued in European Application No. 16152587.8 dated Jun. 1, 2016, 5 pages.

* cited by examiner

*Primary Examiner* — Jonathan Bradford
(74) *Attorney, Agent, or Firm* — Fish & Richardson P.C.

(57) ABSTRACT

A refrigerator includes an icemaker, an ice bank that is configured to store ice released from the icemaker, a weight sensor configured to measure a weight of the ice bank, and a controller configured to determine, based on weight measurements measured by the weight sensor, a variation in amount of ice stored in the ice bank during a set time period, and adjust an ice determination reference value based on the determined variation in the amount of ice stored in the ice bank during the set time period.

19 Claims, 10 Drawing Sheets

REFRIGERATOR WITH ICEMAKER AND METHOD OF OPERATING BASED ON A VARIATION IN THE AMOUNT OF STORED ICE

CROSS-REFERENCE TO RELATED APPLICATION

This application claims the priority benefit of Korean Patent Application No. 10-2015-0012233, filed on Jan. 26, 2015 in the Korean Intellectual Property Office, the disclosure of which is incorporated herein by reference.

FIELD

The present disclosure relates to a refrigerator and a method of operating the same and, more particularly, to a refrigerator having an icemaker and a method of operating the same.

BACKGROUND

Generally, a refrigerator is an apparatus that is used to keep food (hereinafter referred to as a "stored item") fresh using a refrigeration cycle. A refrigerator may include a freezing compartment, where stored items are kept at a temperature below zero, and a refrigerating compartment, where stored items are kept at a temperature above zero.

A refrigerator may be equipped with an icemaker, which produces ice using cold air, and may include an ice bank, in which ice is stored.

The icemaker may continuously produce ice until the ice bank is full of ice, and ice may become jammed in the ice bank.

SUMMARY

According to one aspect, a refrigerator may include an icemaker, an ice bank that may be configured to store ice released from the icemaker, a weight sensor configured to measure a weight of the ice bank, and a controller configured to determine, based on weight measurements measured by the weight sensor, a variation in amount of ice stored in the ice bank during a set time period, and adjust an ice determination reference value based on the determined variation in the amount of ice stored in the ice bank during the set time period.

Implementations according to this aspect may include one or more of the following features. For example, the controller may be configured to set the ice determination reference value to a first reference value based on a determination that the variation of the amount of ice during the set time period exceeds a first set value, and where the controller may be configured to set the ice determination reference value to a second reference value, which is lower than the first reference value, based on a determination that the variation of the amount of ice during the set time period is less than the first set value. The refrigerator may include a discharge device configured to melt the ice stored in the ice bank, where the melted ice is discharged from the ice bank, where the controller may be configured to set the ice determination reference value to a first reference value based on a determination that the variation of the amount of ice during the set time period exceeds a first set value, where the controller may be configured to set the ice determination reference value to a second reference value, which is lower than the first reference value, based on a determination that the variation of the amount of ice during the set time period is less than the first set value, and exceeds a second set value, which is lower than the first set value, and where the controller may be configured to turn on the discharge device based on a determination that the variation of the amount of ice during the set time period is less than the second set value.

The refrigerator may include a discharge device which may be configured to melt the ice stored in the ice bank, where the controller may be configured to turn on the discharge device based on a determination that the variation of the amount of ice during the set time period is below a set lower limit value. The discharge device may include an ice bank heater which may be configured to melt the ice stored in the ice bank, and a drain hose which may be configured to discharge water from the ice bank. The discharge device may include a hot line which may be configured to allow refrigerant to flow through, a hot line valve which may be configured to adjust the supply of refrigerant to the hot line, and a drain hose which may be configured to discharge water from the ice bank. The discharge device may include a drain valve installed on the drain hose. The discharge device may include a drain valve installed on the drain hose.

The refrigerator may include a display unit which may be configured to display information, where the controller may be configured to output an ice disposal signal to the display unit based on a determination that the variation of the amount of ice during the set time period is below a set lower limit value. The controller may be configured to set the ice determination reference value to a first reference value based on a determination that the variation of the amount of ice during the set time period exceeds a first set value, where the controller may be configured to set the ice determination reference value to a second reference value, which is lower than the first reference value, based on a determination that the variation of the amount of ice during the set time period is less than the first set value and exceeds a second set value, which is lower than the first set value, and where the controller may be configured to output an ice disposal signal to the display unit based on a determination that the variation of the amount of ice during the set time period is less than the second set value.

According to another aspect, a refrigerator may include an icemaker, an ice bank that may be configured to store ice released from the icemaker a weight sensor which may be configured to measure a weight of the ice bank, a discharge device which may be configured to melt the ice stored in the ice bank, a display unit which may be configured to display information, and a controller which may be configured to determine, based on weight measurements measured by the weight sensor, a variation in amount of ice stored in the ice bank during a set time period, where the controller may be configured to turn on the discharge device when a determined variation in the amount of ice stored in the ice bank during a set time period is below a set lower limit value, or to output an ice disposal signal to the display unit when the variation in amount of ice during the set time period is below the set lower limit value. Implementations according to this aspect may include one or more of the following features. For example, the controller may be configured to set an ice determination reference value to a first reference value when the variation of the amount of ice during the set time period exceeds a first set value, where the controller may be configured to set the ice determination reference value to a second reference value, which is lower than the first reference value based on a determination that the variation of the amount of ice during the set time period is less than the first set value and exceeds a second set value, which is lower than the first set value, and where the controller may be configured to turn on the discharge device based on a determination that the variation of the ice amount during the set time period is less than the second set value.

The controller may be configured to set an ice determination reference value to a first reference value based on a determination that the variation of the amount of ice during the set time period exceeds a first set value, where the controller may be configured to set the full ice determination reference value to a second reference value, which is lower than the first reference value, based on a determination that the variation of the amount of ice during the set time period is less than the first set value and exceeds a second set value, which is lower than the first set value, and where the controller may be configured to output the ice disposal signal to the display unit based on a determination that the variation of the amount of ice during the set time period is less than the second set value.

According to yet another aspect, a method of operating a refrigerator may include determining a variation in the amount of ice stored in an ice bank during a set time period, and determining an ice determination reference value for the ice bank based on the determined variation of the amount of ice.

Implementations according to this aspect may include one or more of the following features. For example, determining an ice determination reference value may include setting the ice determination reference value to a first reference value based on a determination that the variation of the amount of ice during the set time period exceeds a first set value, and setting the ice determination reference value to a second reference value, which is lower than the first reference value, based on a determination that the variation of the amount of ice during the set time period is less than the first set value. The method may include melting the ice stored in the ice bank to discharge the ice outward based on the determined variation of the ice amount. The method may include setting the ice determination reference value to a first reference value based on a determination that the variation of the amount of ice during the set time period exceeds a first set value, and setting the ice determination reference value to a second reference value, which is lower than the first reference value, based on a determination that the variation of the amount of ice during the set time period less than the first set value and exceeds a second set value, which is lower than the first set value, and where the melting may include turning on a discharge device when the variation of the amount of ice during the set time period is less than the second set value. The method may include displaying the disposal of ice from the ice bank on a display unit based on the determined variation of the amount of ice.

The method may include setting the ice determination reference value to a first reference value based on a determination that the variation of the amount of ice during the set time period exceeds a first set value, and setting the ice determination reference value to a second reference value, which is lower than the first reference value, based on a determination that the variation of the amount of ice during the set time period is less than the first set value and exceeds a second set value, which is lower than the first set value, and where displaying the disposal of ice from the ice bank on the display unit based on a determination that the variation of the amount of ice during the set time period is less than the second set value.

DETAILED DESCRIPTION

Figure 1:
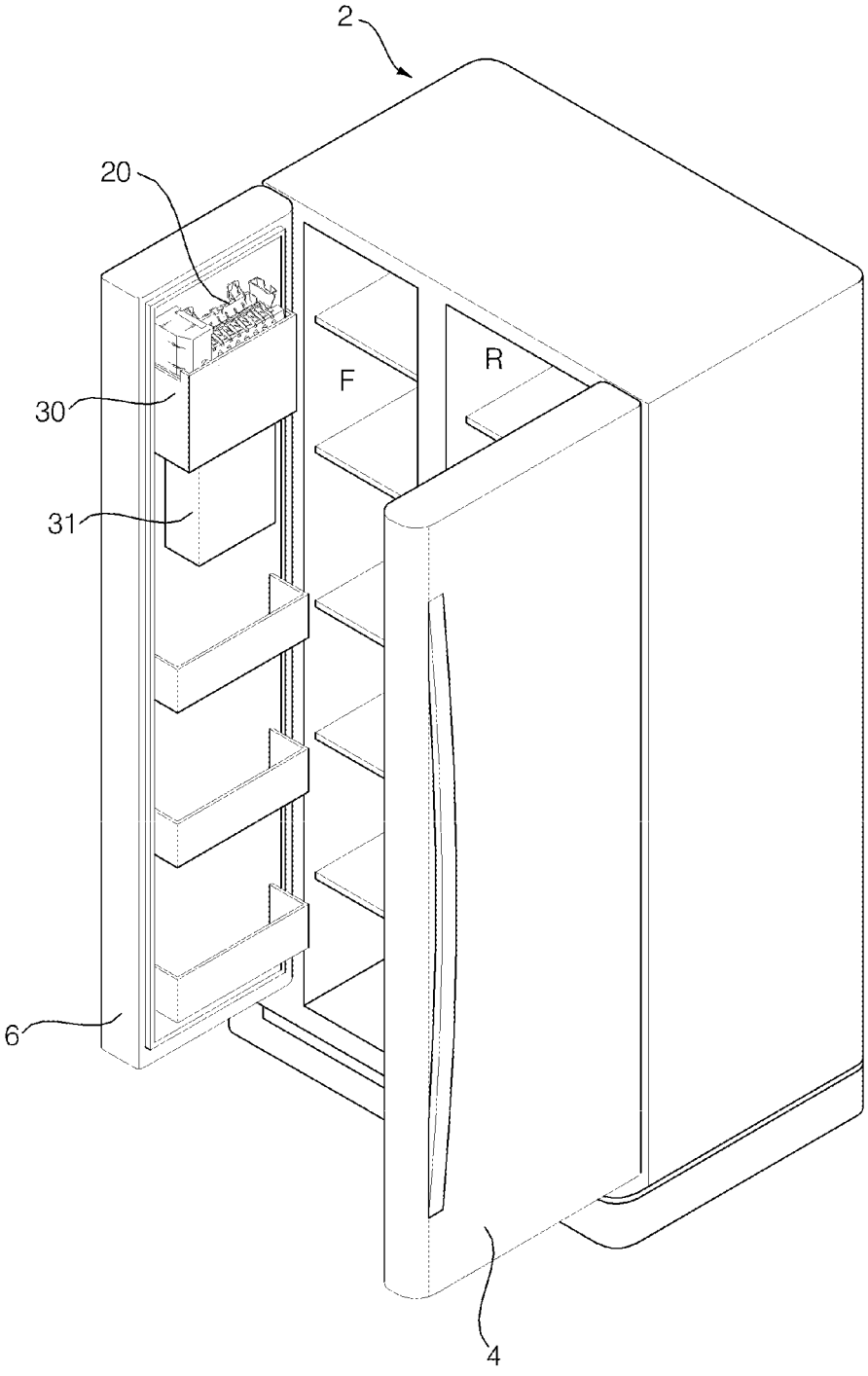
FIG. 1 is a perspective view illustrating an example of the interior of a refrigerator.
Figure 2:
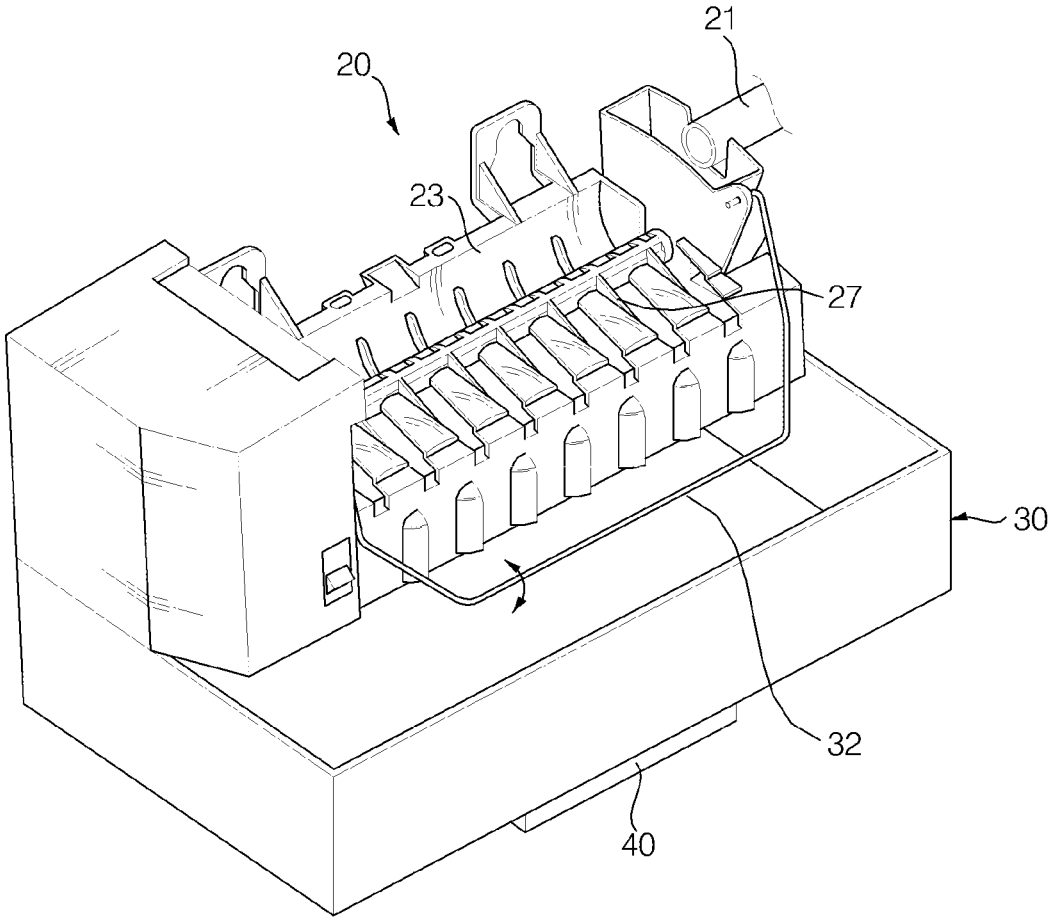
FIG. 2 is a perspective view illustrating an example of an icemaker and an ice bank provided in the refrigerator.
Figure 3:
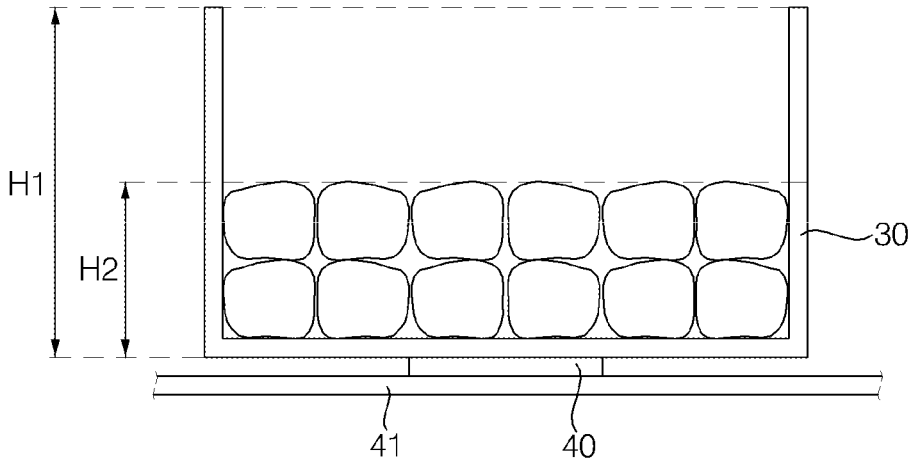
FIG. 3 is a view illustrating an example of the interior of the ice bank provided in the refrigerator.
Figure 4:
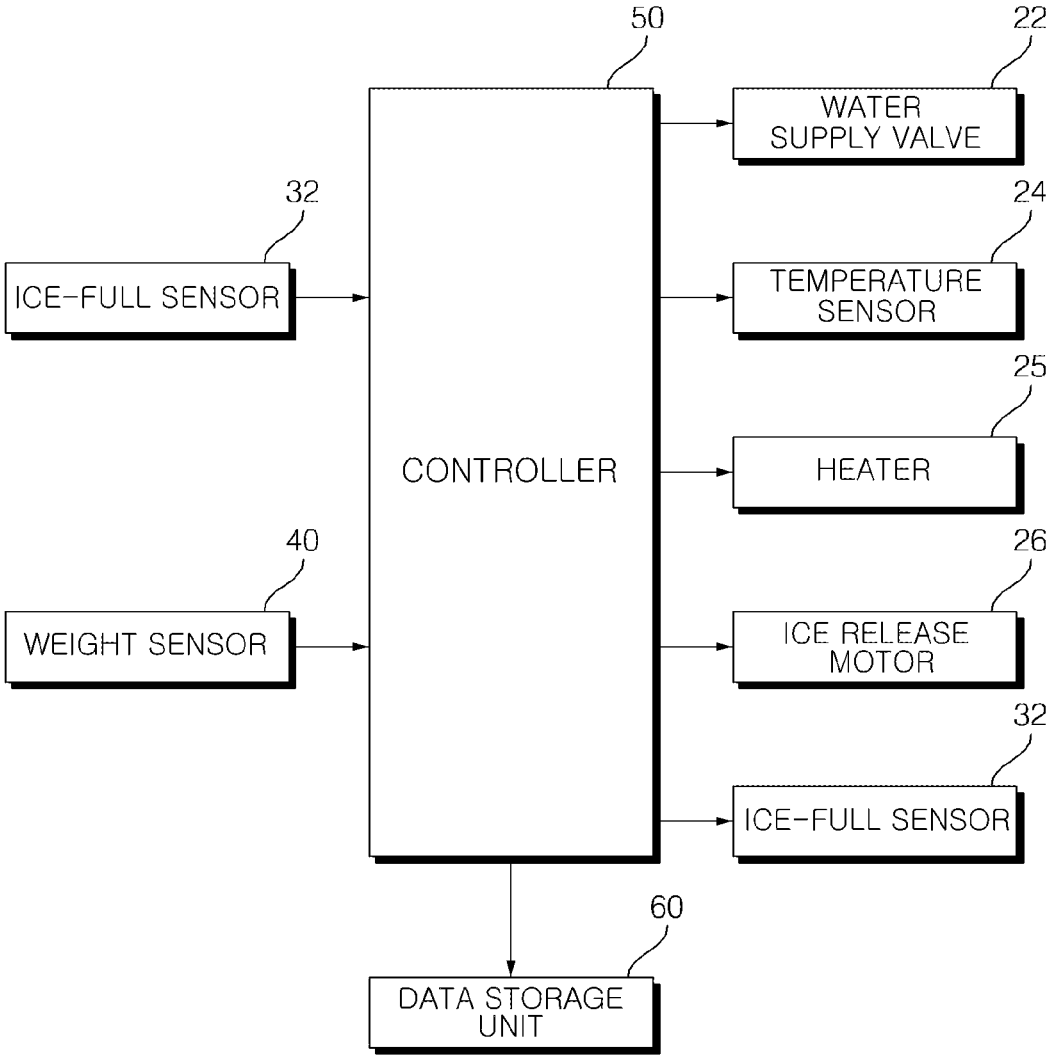
FIG. 4 is a control block diagram illustrating an example of the refrigerator.

FIG. 1 illustrates an example interior of an example refrigerator, FIG. 2 is an enlarged perspective view illustrating an example icemaker and an example ice bank provided in the refrigerator, FIG. 3 is a view illustrating the interior of the ice bank, and FIG. 4 is a control block diagram illustrating an example refrigerator.

As illustrated in FIG. 1, a refrigerator may include a main body 2, in which one or more storage compartments F and R may be defined, and one or more doors 4 and 6 may be installed to the main body 2 and are configured to open or close the storage compartments F and R. The refrigerating compartment R and the freezing compartment F may be defined in the main body 2, and the doors 4 and 6 may include the refrigerating compartment door 4 which is configured to open or close the refrigerating compartment R and the freezing compartment door 6 which is configured to open or close the freezing compartment F.

The refrigerator may include an icemaker 20, in which water is made into ice, and an ice bank 30, in which ice released from the icemaker 20 is accommodated. The refrigerator may further include a weight sensor 40, which is configured to sense the weight of the ice bank 30.

The icemaker 20 may be installed to the main body 2 to be located inside the freezing compartment F. In some examples, the icemaker 20 may be disposed on the door 6 to be located on the rear surface of the door 6. The icemaker may make ice from water using cold air inside the freezing compartment F. The ice bank 30 may also be disposed on the door 6 to be located on the rear surface of the door 6.

The refrigerator may further include a dispenser 31 through which the ice accommodated in the ice bank 30 may be discharged outward. The dispenser 31 may be installed to the door 6.

The icemaker 20 may make ice and deliver the ice to the ice bank 30, and the ice accommodated in the ice bank 30 may be discharged outward through the dispenser 31.

In the examples where the ice bank 30 is disposed on the door 6, as illustrated in FIG. 3, the door 6 may include a weight sensor mounting plate 41, on which the weight sensor 40 is mounted. The weight of the ice bank 30 may vary according to the amount of ice accommodated in the ice bank 30, and the weight sensor 40 may sense the weight of the ice bank 30, and output a signal value corresponding to the sensed weight to a controller 50.

The refrigerator may include a water supply hose 21, which is configured to guide water into the icemaker 20. The refrigerator may further include a water supply valve 22, which admits or blocks the supply of water to the icemaker 20. The water supply valve 22 may be installed on the water supply hose 21, and may control the water passing through the water supply hose 21. The water supply valve 22 may be opened when switched on, thus allowing the water to be supplied to the icemaker 20 by passing through the water supply hose 21. The water supply valve 22 may be closed when switched off, and may block the supply of water through the water supply hose 21.

The icemaker 20 may include an ice-making tray 23, in which the water supplied through the water supply hose 21 is accommodated. The ice-making tray 23 defines an ice-making space, in which water is accommodated, and the water supplied from the water supply hose 21 into the ice-making space may be made into ice by cold air inside the freezing compartment F.

The icemaker 20 may further include a temperature sensor 24, which is configured to measure the temperature inside the icemaker 20. The temperature sensor 24 may be installed to the ice-making tray 23, and may sense the temperature of the ice-making tray 23 and output the sensed temperature to the controller 50. The controller 50 may determine whether or not the ice-making operation of the icemaker 20 is completed based on a temperature signal output from the temperature sensor 24.

The icemaker 20 may further include a heater 25, which is configured to melt the ice made in the ice-making tray 23 to allow the ice to be easily separated from the ice-making tray 23. The heater 25 may be installed to the ice-making tray 23. The heater 25 may heat the ice-making tray 23 to raise the temperature of the ice-making tray 23 when it is required to release the ice into the ice bank 30, and the ice in contact with the ice-making tray 23 may be melted, which may ensure the easy release of ice by an ice release device.

The icemaker 20 may further include an ice release device, which is configured to drop the ice made in the icemaker 20 into the ice bank 30.

When the ice release device is turned on, the ice release device may scoop up the ice from the icemaker 20 and drop the ice into the ice bank 30. The ice release device may include an ice release motor 26, and an ejector 27, which is rotated by the ice release motor 26 and scoops up the ice from the icemaker 20.

Alternatively, when the ice release device is turned on, the ice release device may twist the ice-making tray 23 to drop the ice from the ice-making tray 23 into the ice bank 30. The ice release device may include an ice release motor 26, which is connected to the ice-making tray 23 and rotates the ice-making tray 23, and a protrusion to be caught by the ice-making tray 23 to cause the ice-making tray 23 to be twisted.

The refrigerator may include an ice-full sensor 32, which is configured to sense that the ice-bank 30 is full of ice. The ice-full sensor 32 may function to sense the height of ice accommodated in the ice bank 30. Various types of sensors may be used as the ice-full sensor 32, each of the various types of sensors being configured to sense the height of ice accommodated in the ice bank 30.

The ice-full sensor 32 may include a lever located above the ice bank 30 which is configured to be pivotally rotated up and down, and a lever rotator which is configured to rotate the lever. The height of ice accommodated in the ice bank 30 may be sensed by the rotation angle of the lever rotator.

In some examples, the ice-full sensor 32 may include an elevating member which is configured to be vertically moved into the ice bank 30, and an elevator which is configured to vertically move the elevating member, and may sense the height of ice accommodated in the ice bank 30.

The ice-full sensor 32 may be for example, an ultraviolet sensor, which may be capable of sensing the height of ice from a long distance away.

The refrigerator may sense the amount of ice by the weight sensor 40. The weight sensor 40 may sense the weight of the ice bank 30 and output the sensed value to the controller 50. The controller 50 may determine whether or not the ice bank 30 is full of ice based on the output value from the weight sensor 40. The refrigerator may control the water supply valve 22 and the ice release device, and may adjust the amount of ice inside the ice bank 30, based on the height of ice sensed by the ice-full sensor 32 or the weight of ice sensed by the weight sensor 40.

The refrigerator may sense variation in the weight of the ice bank 30 based on the value sensed by the weight sensor 40, and may sense variation in the amount of ice during a set period. The refrigerator may be controlled in different ways based on the ice amount variation during the set period.

The set period may be a time period that is set to sense the ice usage pattern of the user such as, for example, one month or one week.

For example, when variation in the amount of ice exceeds a first set value during a set period of one month, this may be determined as a usage pattern in which the amount of ice that is used is large, and the refrigerator may be controlled such that a large amount of ice is stored in the ice bank 30.

Conversely, when the ice amount variation is equal to or less than the first set value during the set time of one month, this may be determined as a usage pattern in which the amount of ice that is used is not large, and the refrigerator may be controlled such that a small amount of ice is stored in the ice bank 30.

In some examples, when variation in the amount of ice is equal to or less than a second set value, which is lower than the first set value, during a set period of one month, this may be determined as a usage pattern in which almost no ice has been used for a long time, and the refrigerator may directly dispose of the ice accommodated in the ice bank 30 via a discharge device, or may display information recommending that the user disposes of the ice.

The refrigerator may adjust the amount of ice in the ice bank 30 via the control of the water supply valve 22 and the control of the ice release device. The refrigerator may include the controller 50 to control the icemaker 20 and the water supply valve 22.

The controller 50 may control each of the water supply valve 22 and the ice release device to prevent the delivery of the ice from the icemaker 20 to the ice bank 30 when it is determined that the ice bank 30 is full of ice. When it is determined that the ice bank 30 is full of ice, the controller 50 may be configured to keep the water supply valve 22 switched off, and may also be configured keep the icemaker 20, or more precisely, the ice release device, turned off. In this state, the icemaker 20 does not release the ice into the ice bank 30.

The controller 50 may vary a full ice determination reference value. The full ice determination reference value may be a reference value for determining whether or not the ice bank 30 is full of ice. When the full ice determination reference value is set to a high value, the refrigerator may determine that the ice bank 30 is full of ice when a large amount of ice is accommodated in the ice bank 30. On the other hand, when the full ice determination reference value is set to a low value, the refrigerator may determine that the ice bank 30 is full of ice when the amount of ice is not large, but has reached the full ice determination reference value.

When the controller 50 sets the full ice determination reference value to a high value, a large amount of ice may be stored in the ice bank 30. When the controller 50 sets the full ice determination reference value to a low value, a small amount of ice may be stored in the ice bank 30.

The controller 50 may vary the full ice determination reference value based on the extent of variation in the amount of ice in the ice bank 30 during a set period.

When the variation in the amount of ice during the set period exceeds the first set value, the controller 50 may set the full ice determination reference value to a first reference value H1. When the full ice determination reference value is the first reference value H1, the refrigerator may make and store ice such that the amount of ice in the ice bank 30 does not exceed the first reference value H1.

When the variation in the amount of ice during the set period is equal to or less than the first set value, the controller 50 may set the full ice determination reference value to a second reference value H2, which is smaller than the first reference value H1 (H2<H1). When the full ice determination reference value is the second reference value H2, the refrigerator may make and store ice such that the amount of ice in the ice bank 30 does not exceed the second reference value H2, and the ice bank 30 may accommodate a smaller amount of ice than in the case where the full ice determination reference value is set to the first reference value H1.

Each of the first reference value H1 and the second reference value H2 may be determined based on the height of ice accommodated in the ice bank 30, or may be determined based on the weight of ice accommodated in the ice bank 30.

In some examples, the first reference value H1 may be 10 cm, as determined based on the height of ice, and the second reference value H2 may be 5 cm, as determined based on the height of ice.

In the example where the first reference value H1 may be 10 cm, the controller 30 may determine that the ice bank 30 is full of ice when the height of ice sensed by the ice-full sensor 32 is 10 cm or more.

In addition, in the example where the second reference value H2 may be 5 cm, the controller 50 may determine that the ice bank 30 is full of ice when the height of ice sensed by the ice-full sensor 32 is 5 cm or more.

In another example, the first reference value H1 may be 2.2 kg, as determined based on the weight of ice, and the second reference value H2 may be 1.2 kg, as determined based on the weight of ice.

In the example where the first reference value H1 may be 2.2 kg, the controller 30 may determine that the ice bank 30 is full of ice when the weight of ice sensed by the weight sensor 40 is 2.2 kg or more.

In addition, in the example where the second reference value H2 may be 1.2 kg, the controller 50 may determine that the ice bank 30 is full of ice when the weight of ice sensed by the weight sensor 40 is 1.2 kg or more.

The weight sensor 40 may periodically sense the weight of the ice bank 30 and output the sensed value to the controller 50. The weight sensor 40 may sense the weight of the ice bank 30 before and after the discharge of ice and output the sensed values to the controller 50. The controller 50 may take a value, acquired by subtracting the weight of ice after the discharge of ice from the weight of ice before the discharge of ice, as the variation in the amount of ice. The controller 50 may store the determined ice amount variation in a data storage unit 60 such as, for example, a memory. For example, when the value sensed by the weight sensor 40 before the discharge of ice is 2 kg and the value sensed by the weigh sensor 40 after the discharge of ice is 1.8 kg, the ice amount variation may be 0.2 kg. The controller 50 may store the calculated value of 0.2 kg in the data storage unit 60.

The controller 50 may determine the ice amount variation before and after the discharge of ice and store the determined value in the data storage unit 60 each time the discharge of ice is performed.

The controller 50 may add respective ice amount variation values obtained during the set period, may compare the added ice amount variation during the set period with the first set value, and may determine the full ice determination reference value based on the comparison result.

The full ice determination reference value may be determined based on the height of ice in the ice bank 30, and the controller 50 may vary the height of ice in the ice bank 30, which may be checked to determine whether or not the ice bank 30 is full of ice.

Alternatively, the full ice determination reference value may be determined based on the weight of ice in the ice bank 30, and the controller 50 may vary the weight of ice in the ice bank 30, which may be checked to determine whether or not the ice bank 30 is full of ice.

In the examples where the user may discharge the ice in the ice bank 30 a total of five times in one month, and during this set period of one month, the firstly discharged amount of ice is sensed as 0.3 kg, the secondly discharged amount of ice is sensed as 0.5 kg, the thirdly discharged amount of ice is 0.4 kg, the fourth discharged amount of ice is 0.2 kg, and the fifthly discharged amount of ice is 0.7 kg, the controller 50 may add the ice amount variations during one month, and may compare the added ice amount variations with the first set value of 2 kg. When the total ice variation based on five discharges of ice exceeds 2 kg, the controller 50 may set the full ice determination reference value to 10 cm.

The refrigerator may produce ice such that the height of ice in the ice bank 30 becomes approximately 10 cm, and thus ice, the height of which is approximately 10 cm, may be stored in the ice bank 30.

In the examples where the user may discharge the ice in the ice bank 30 a total of four times in one month, and during this set period of one month, the firstly discharged amount of ice is sensed as 0.3 kg, the secondly discharged amount of ice is sensed as 0.5 kg, the thirdly discharged amount of ice is 0.4 kg, and the fourth discharged amount of ice is 0.2 kg, the controller 50 may add the ice amount variations during one month, and may compare the added ice amount variations with the first set value of 2 kg. When the total ice amount variation based on four discharges of ice is equal to or less than 2 kg, the controller 50 may set the full ice determination reference value to 5 cm.

The refrigerator may produce ice such that the height of ice in the ice bank 30 becomes approximately 5 cm, and thus ice, the height of which is approximately 5 cm, may be stored in the ice bank 30.

In the examples where the user may discharge the ice in the ice bank 30 a total of five times in one month, and during this set period of one month, the firstly discharged amount of ice is sensed as 0.3 kg, the secondly discharged amount of ice is sensed as 0.5 kg, the thirdly discharged amount of ice is 0.4 kg, the fourth discharged amount of ice is 0.2 kg, and the fifthly discharged amount of ice is 0.7 kg, the controller 50 may add the ice amount variations during one month, and may compare the added ice amount variations with the first set value of 2 kg. When the total ice amount variation based on five discharges of ice exceeds 2 kg, the controller 50 may set the full ice determination reference value to 2.2 kg.

The refrigerator may produce ice such that the weight of ice in the ice bank 30 becomes approximately 2.2 kg, and thus ice, the weight of which is approximately 2.2 kg, may be stored in the ice bank 30.

In the examples where the user may discharge the ice in the ice bank 30 a total of four times in one month, and during this set period of one month, the firstly discharged amount of ice is sensed as 0.3 kg, the secondly discharged amount of ice is sensed as 0.5 kg, the thirdly discharged amount of ice is 0.4 kg, and the fourth discharged amount of ice is 0.2 kg, the controller 50 may add the ice amount variations during one month, and may compare the added ice amount variations with the first set value of 2 kg. When the total ice amount variation based on four discharges of ice is equal to or less than 2 kg, the controller 50 may set the full ice determination reference value to 1.2 kg.

The refrigerator may produce ice such that the weight of ice in the ice bank 30 becomes approximately 1.2 kg, and thus ice, the weight of which is approximately 1.2 kg, may be stored in the ice bank 30.

Figure 5:
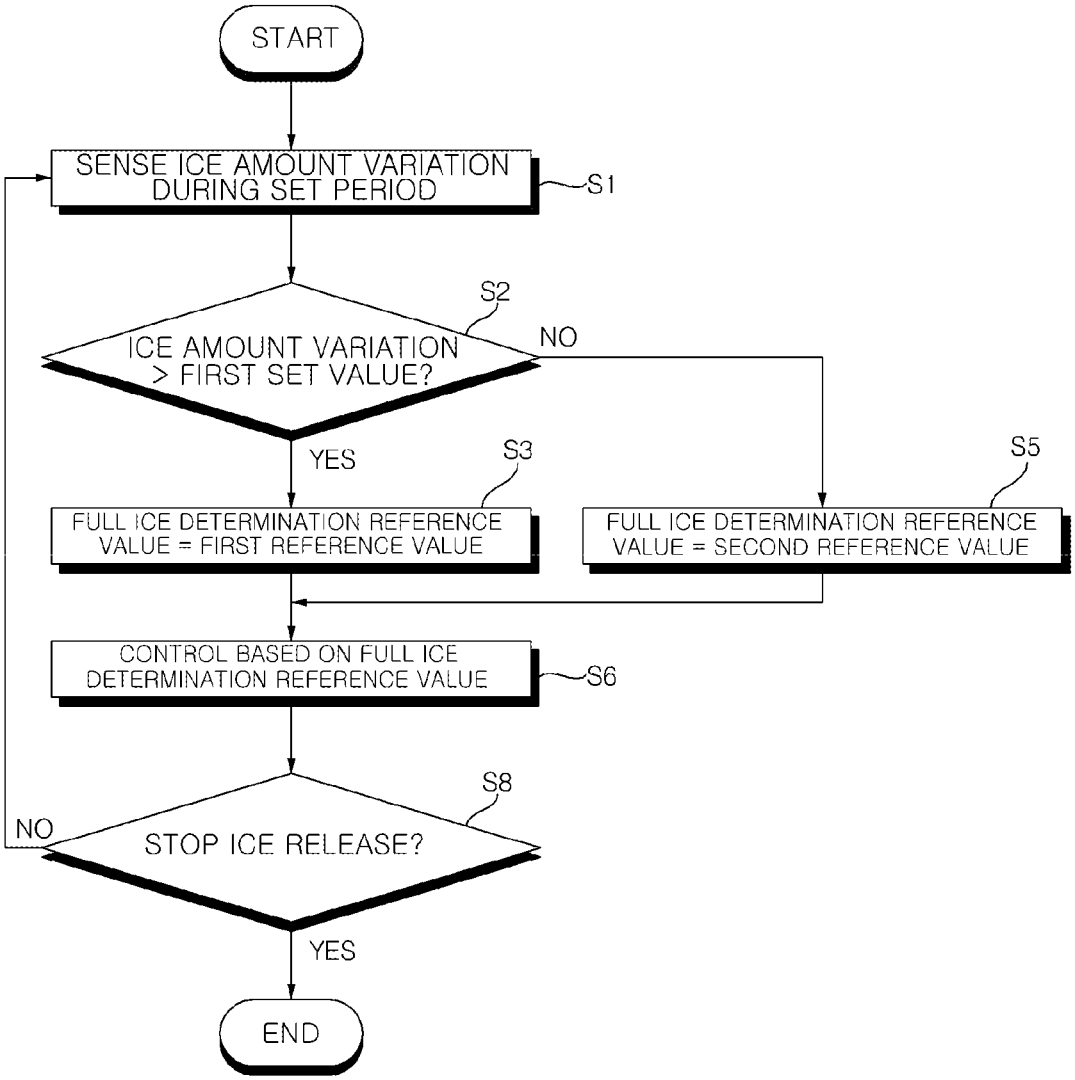
FIG. 5 is a flowchart illustrating an example of a method of operating the refrigerator.

FIG. 5 is a flowchart illustrating a method of operating the refrigerator.

The method may include a first step S1 of sensing variation in the amount of ice in the ice bank 30 during a set period, and a second step S2, S3, S5 and S6 of determining a full ice determination reference value for the ice bank 30 based on the ice amount variation sensed in the first step S1.

In the first step S1, the weight sensor 40 may sense the weight of the ice bank 30 and output the sensed value to the controller 50. The controller 50 may sense the ice amount variation in the ice bank 30 during the set period using variation in the weight of the ice bank 30 output from the weight sensor 40.

When the ice amount varies N times during the set period, the controller 50 may calculate respective ice amount variations each time such ice amount variation occurs, and may add the calculated ice amount variations. The sum of the ice amount variations may be the total ice amount variation in the ice bank 30 during the set period.

For example, in the case where the set period is one month and the discharge of ice occurs a total of five times in one month, the controller 50 may calculate respective ice amount variations V1, V2, V3, V4 and V5 whenever the discharge of ice occurs, and the sum of the calculated five ice amount variations V1, V2, V3, V4 and V5 (Vtotal=V1+V2+V3+V4+V5) may be the ice amount variation in the ice bank 30 during one month. The sensed ice amount variation Vtotal in the ice bank 30 during the set period may be used to determine the full ice determination reference value in the second step.

The second step S2, S3, S5 and S6 may include setting the full ice determination reference value to a first reference value when the ice amount variation during the set period exceeds a first set value (S2 and S3). The controller 50 may set the full ice determination reference value to the higher first reference value when the total ice amount variation Vtotal, sensed in the first step S1, exceeds the first reference value (S2 and S3).

The second step S2, S3, S5 and S6 may include setting the full ice determination reference value to a second reference value, which is lower than the first reference value, when the ice amount variation during the set period is equal to or less than the first set value (S2 and S5). The controller 50 may set the full ice determination reference value to the lower second reference value when the total ice amount variation Vtotal, sensed in the first step S1, is equal to or less than the first reference value (S2 and S5).

The first set value may be a prescribed value which is set in order to determine the ice usage pattern of the user, and the prescribed value may be, for example, 1 kg, 2 kg, 2.2 kg, or 3 kg.

The first reference value and the second reference value may be determined based on the height of ice, or may be determined based on the weight of ice.

In some examples, the second step S2, S3, S5 and S6 may include controlling the refrigerator based on the full ice determination reference value determined as described above (S6).

The second step S2, S3, S5 and S6 may include controlling the icemaker 20 and the water supply valve 22 based on the full ice determination reference value when the full ice determination reference value is set to the first reference value or the second reference value (S6). The icemaker 20 may make ice and release the ice into the ice bank 30 until the height or weight of ice in the ice bank 30 becomes the first reference value or the second reference value. Then, once the height or weight of ice has reached the first reference value or the second reference value, the icemaker 20 may no longer release the ice into the ice bank 30, and may enter a standby state (S6).

The method of operating the refrigerator may include a step S8 of no longer controlling the icemaker 20 and the water supply valve 22 and causing the icemaker 20 to stop releasing the ice into the ice bank 30 when an ice-making stop command is input via an input unit of a control panel, or when the refrigerator is powered off.

When no ice-making stop command is input, or when the refrigerator is not powered off, the method of operating the refrigerator may return to the first step S1.

The full ice determination reference value may change at a set interval, and when the full ice determination reference value changes after the set period has elapsed, the icemaker 20 and the water supply valve 22 may be controlled based on the changed full ice determination reference value.

Figure 6:
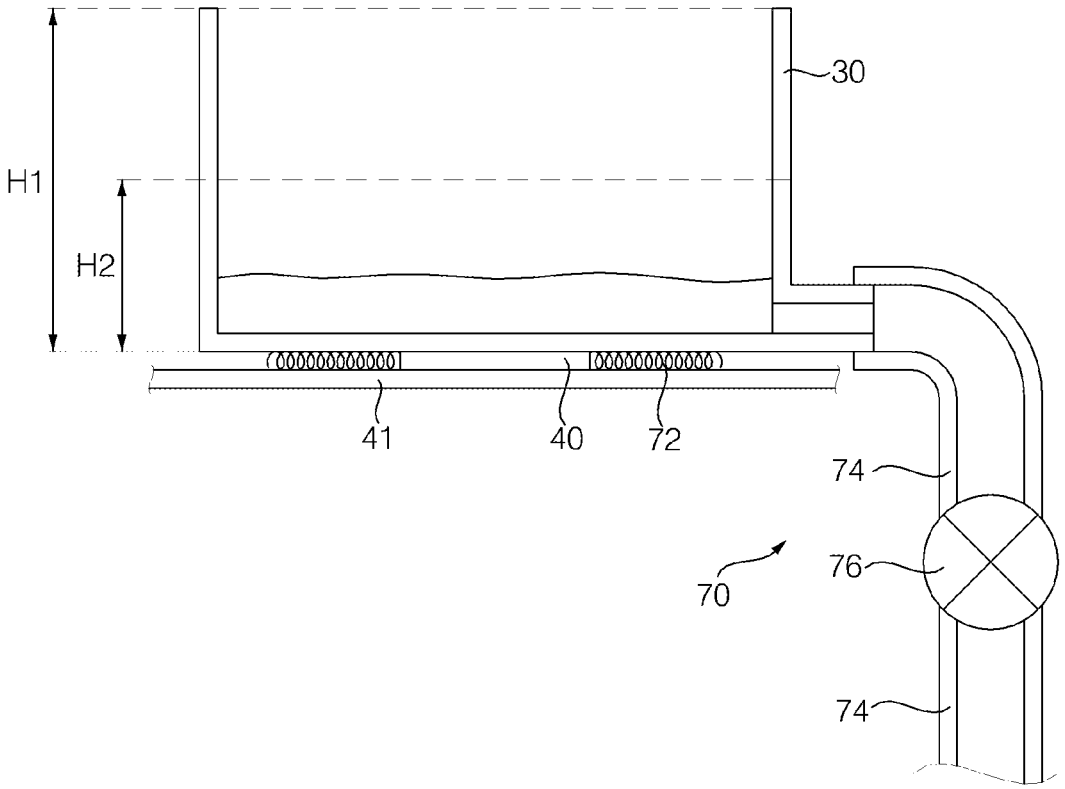
FIG. 6 is a view illustrating an example of the schematic configuration of a refrigerator.
Figure 7:
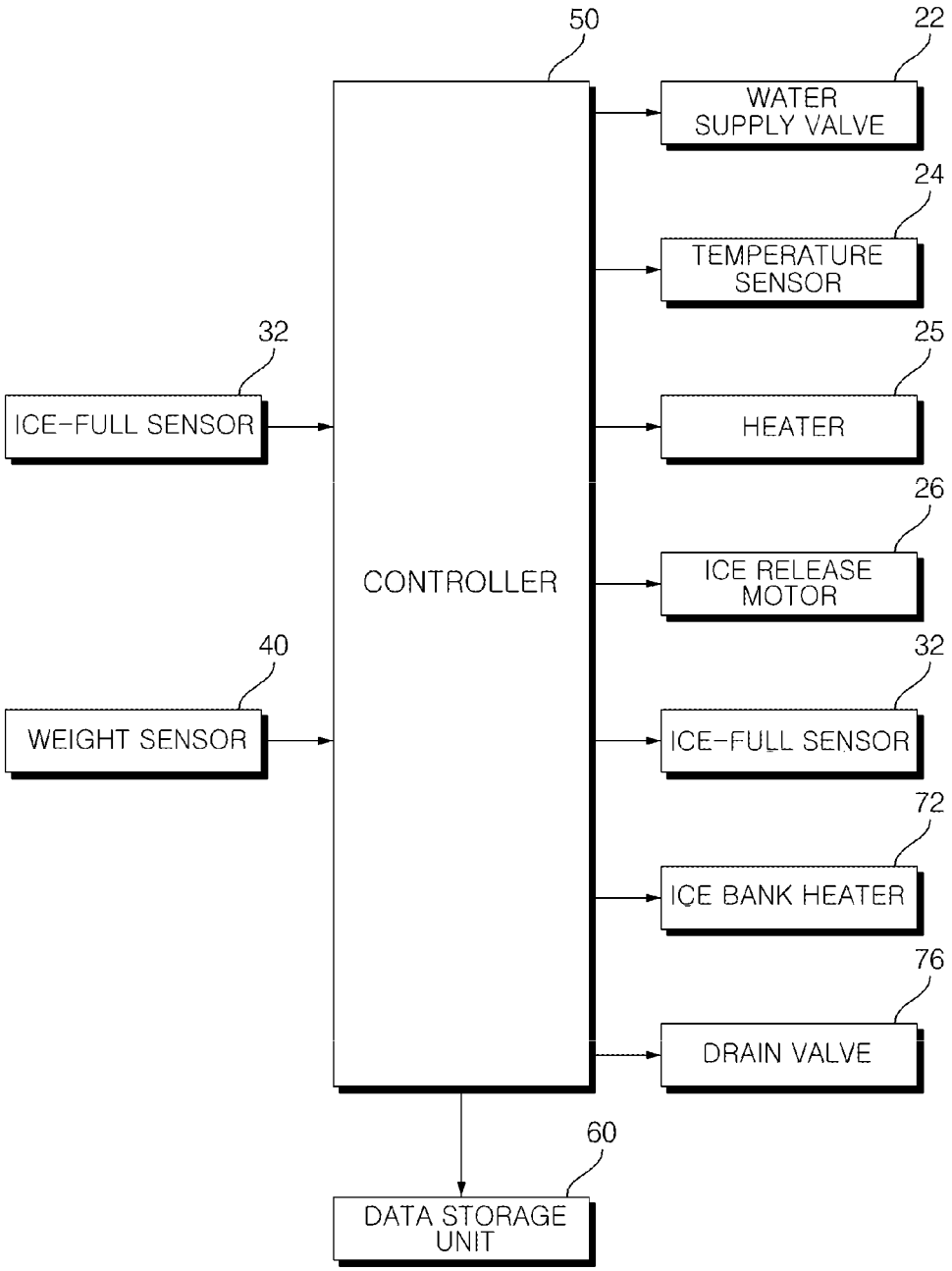
FIG. 7 is a control block diagram illustrating an example of the refrigerator.

As illustrated in FIG. 6, the refrigerator may further include a discharge device 70, which is configured to melt the ice accommodated in the ice bank 30 and discharge the ice to the outside.

The controller 50 may turn on the discharge device 70 when the variation in the amount of ice during a set period is below a set lower limit value. The set lower limit value is a value that is set to determine the disposal of ice, and may be set to a prescribed value, for example, 0.1 kg or 0.3 kg.

The discharge device 70 may include an ice bank heater 72, which is configured to melt the ice in the ice bank 30, and a discharge hose 74, through which water may be discharged from the ice bank 30.

The ice bank heater 72 may be installed to the ice bank 30 to melt the ice accommodated in the ice bank 30. The ice bank heater 72 may be configured as an electric heater. The ice bank heater 72 may be controlled by the controller 50. When the ice inside the ice bank 30 has not been discharged for a long time, or when the amount of ice that has been discharged during the set period is below the set lower limit value, the controller 50 may turn on the ice bank heater 72 in order to dispose of the ice in the ice bank 30. When the ice bank heater 72 is turned on, the temperature of the ice bank heater 72 is increased to melt the ice accommodated in the ice bank 30, and the resulting water in the ice bank 72 may be discharged through the drain hose 74. The ice bank heater 72 may be turned on for a set heating period and may be turned off after the set heating period has elapsed.

The discharge device 70 may include a hot line through which refrigerant passes, a hot line valve configured to adjust the amount of refrigerant supplied to the hot line, and the drain hose 74, through which water is discharged from the ice bank 30.

The hot line and the hot line valve may function as a heater to melt the ice using heat from the refrigerant. The hot line and the hot line valve may be installed instead of an electric heater, or may be installed along with the electric heater.

At least a portion of the hot line may be installed to the ice bank 30, and may melt the ice accommodated in the ice bank 30 by transferring the heat from refrigerant to the ice bank 30. The hot line may be connected between a compressor and a condenser such that a portion of the refrigerant compressed in the compressor is used to melt the ice accommodated in the ice bank 30.

The hot line may be connected between the condenser and an expander such that a portion of the refrigerant having passed through the condenser is used to melt the ice accommodated in the ice bank 30.

The hot line valve may be a valve which is configured to control the rate of flow of refrigerant that passes through the hot line. The hot line valve may normally kept closed, but may be switched on to supply high temperature refrigerant to the hot line upon the disposal of ice. The hot line valve may be switched on during a set valve period, and may be switched off when the set valve period has elapsed.

The discharge device 70 may further include a drain valve 76 installed on the drain hose 74. The drain valve 76 may normally kept closed, but may be switched on upon the disposal of ice such that the water moved from the ice bank 30 to the drain hose 74 is drained. The drain valve 76 may be switched on during a set drainage period, and may be switched off when the set drainage period has elapsed.

The controller 50 may set a full ice determination reference value to a first reference value when variation in the amount of ice during a set period exceeds a first set value.

When the ice amount variation during the set period is equal to or less than the first set value and exceeds a second set value, which is lower than the first set value, the controller 50 may set the full ice determination reference value to a second reference value, which is lower than the first reference value.

The controller 50 may turn on the discharge device 70 when the ice amount variation during the set period is equal to or less than the second set value. When the discharge device 70 is turned on, the controller 50 may turn on the ice bank heater 72 and may switch on the drain valve 76 so as to open the drain valve 76.

The second set value is a value, which is set to determine the disposal of ice, and may be set to a prescribed value, such as 0.1 kg or 0.3 kg. The second set value may be a set lower limit value to determine whether to turn on or off the discharge device 70.

In some examples, the user may discharge the ice in the ice bank 30 a total of five times in one month, and during this set period of one month, the firstly discharged amount of ice is sensed as 0.3 kg, the secondly discharged amount of ice is sensed as 0.5 kg, the thirdly discharged amount of ice is 0.4 kg, the fourth discharged amount of ice is 0.2 kg, and the fifthly discharged amount of ice is 0.7 kg, the controller 50 may add the ice amount variations during one month, and may compare the added ice amount variations with the first set value of 2 kg and the second set value of 0.3 kg. When the total ice variation based on five discharges of ice exceeds 2 kg, the controller 50 may set the full ice determination reference value to 10 cm.

The refrigerator may produce ice such that the height of ice in the ice bank 30 becomes approximately 10 cm, and thus ice, the height of which is approximately 10 cm, may be stored in the ice bank 30.

In some examples the user may discharge the ice in the ice bank 30 a total of four times in one month, and during this set period of one month, the firstly discharged amount of ice is sensed as 0.3 kg, the secondly discharged amount of ice is sensed as 0.5 kg, the thirdly discharged amount of ice is 0.4 kg, and the fourth discharged amount of ice is 0.2 kg, the controller 50 may add the ice amount variations during one month, and may compare the added ice amount variations with the first set value of 2 kg and the second set value of 0.3 kg. When the total ice amount variation based on four discharges of ice is equal to or less than 2 kg and exceeds 0.3 kg, the controller 50 may set the full ice determination reference value to 5 cm.

The refrigerator may produce ice such that the height of ice in the ice bank 30 becomes approximately 5 cm, and thus ice, the height of which is approximately 5 cm, may be stored in the ice bank 30.

In another example, when the user has not discharged ice from the ice bank 30 for one month, or has only discharged 0.2 kg of ice from the ice bank 30 in one month, the controller 50 may compare the ice amount variation with the first set value of 2 kg and the second set value of 0.3 kg. When the ice amount variation for one month is equal to or less than 0.3 kg, the controller 50 may turn on the discharge device 70.

When the discharge device 70 is turned on, the ice bank heater 72 may be turned on and the drain valve 76 may be switched on. When the ice bank heater 72 is turned on, the ice bank heater 72 may melt the ice accommodated in the ice bank 30, and water generated as the ice in the ice bank 30 is melted may be drained outward through the drain hose 74.

The discharge device 70 may be turned off automatically after a set period has elapsed since it was turned on, or may be turned off manually through user operation.

Figure 8:
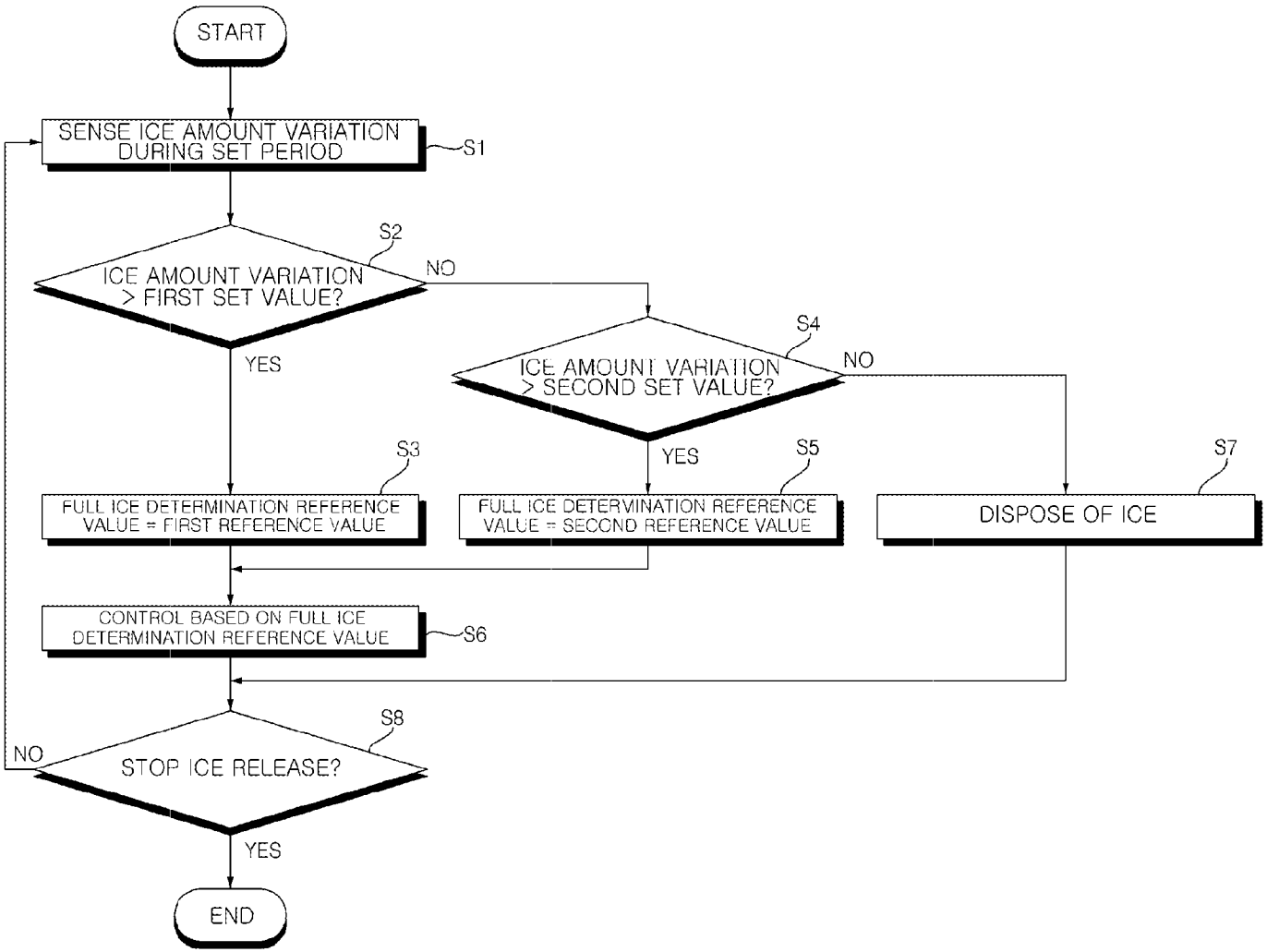
FIG. 8 is a flowchart illustrating an example of a method of operating the refrigerator.

FIG. 8 is a flowchart illustrating a method of operating the refrigerator.

The method may include a first step S1 of sensing variation in the amount of ice in the ice bank 30 during a set time, and a second step S2, S3, S4, S5, S6 and S7 of determining a full ice determination reference value for the ice bank 30 based on the ice amount variation sensed in the first step S1, or melting and discharging the ice from the ice bank 30.

The second step S2, S3, S4, S5, S6 and S7 may include determining the full ice determination reference value based on the sensed ice amount variation when the ice amount variation during the set period exceeds a set lower limit value (S2, S3, S4 and S5). The second step S2, S3, S4, S5, S6 and S7 may include disposing of the ice when the ice amount variation during the set period is equal to or less than the set lower limit value (S2, S4 and S7).

The second step S2, S3, S4, S5, S6 and S7 may include setting the full ice determination reference value to a first reference value when the ice amount variation during the set period exceeds a first set value (S2 and S3).

The second step S2, S3, S4, S5, S6 and S7 may include setting the full ice determination reference value to a second reference value, which is lower than the first reference value, when the ice amount variation during the set period is equal to or less than the first set value and exceeds a second set value, which is lower than the first set value (S2, S4 and S5).

The second step S2, S3, S4, S5, S6 and S7 may include controlling the refrigerator based on the full ice determination reference value determined as described above (S6). When the full ice determination reference value has been determined to the first reference value or the second reference value, the method of operating the refrigerator may include controlling the icemaker 20 and the water supply valve 22 (S6). The icemaker 20 may make ice and release ice the ice into the ice bank 30 until the height or weight of ice in the ice bank 30 becomes the first reference value or the second reference value. When the height or weight of ice has reached the first reference value or the second reference value, the icemaker 20 may no longer release the ice into the ice bank 30 and may enter a standby state (S6).

The second step S2, S3, S4, S5, S6 and S7 may include turning on the discharge device 70 when the ice amount variation during the set period is equal to or less than the second set value (S2, S4 and S7).

When attempting to turn on the discharge device 70, the discharge device 70 may be turned on during a set discharge period to dispose of the ice in the ice bank 30 (S7). Once the set discharge period has elapsed, the controller 50 may turn off the ice bank heater 72 and may switch off the drain valve 76 to close the drain valve 76.

The method of operating the refrigerator may include a step S8 of no longer controlling the icemaker 20 and the water supply valve 22 and causing the icemaker 20 to stop releasing the ice into the ice bank 30 when an ice-making stop command is input via an input unit of a control panel, or when the refrigerator is powered off.

When no ice-making stop command is input, or when the refrigerator is not powered off, the method of operating the refrigerator may return to the first step S1. In the method of operating the refrigerator, when the full ice determination reference value changes after the set period has elapsed, the icemaker 20 and the water supply valve 22 may be controlled based on the changed full ice determination reference value, or the discharge device 70 may be turned on so as to dispose of the ice.

Figure 9:
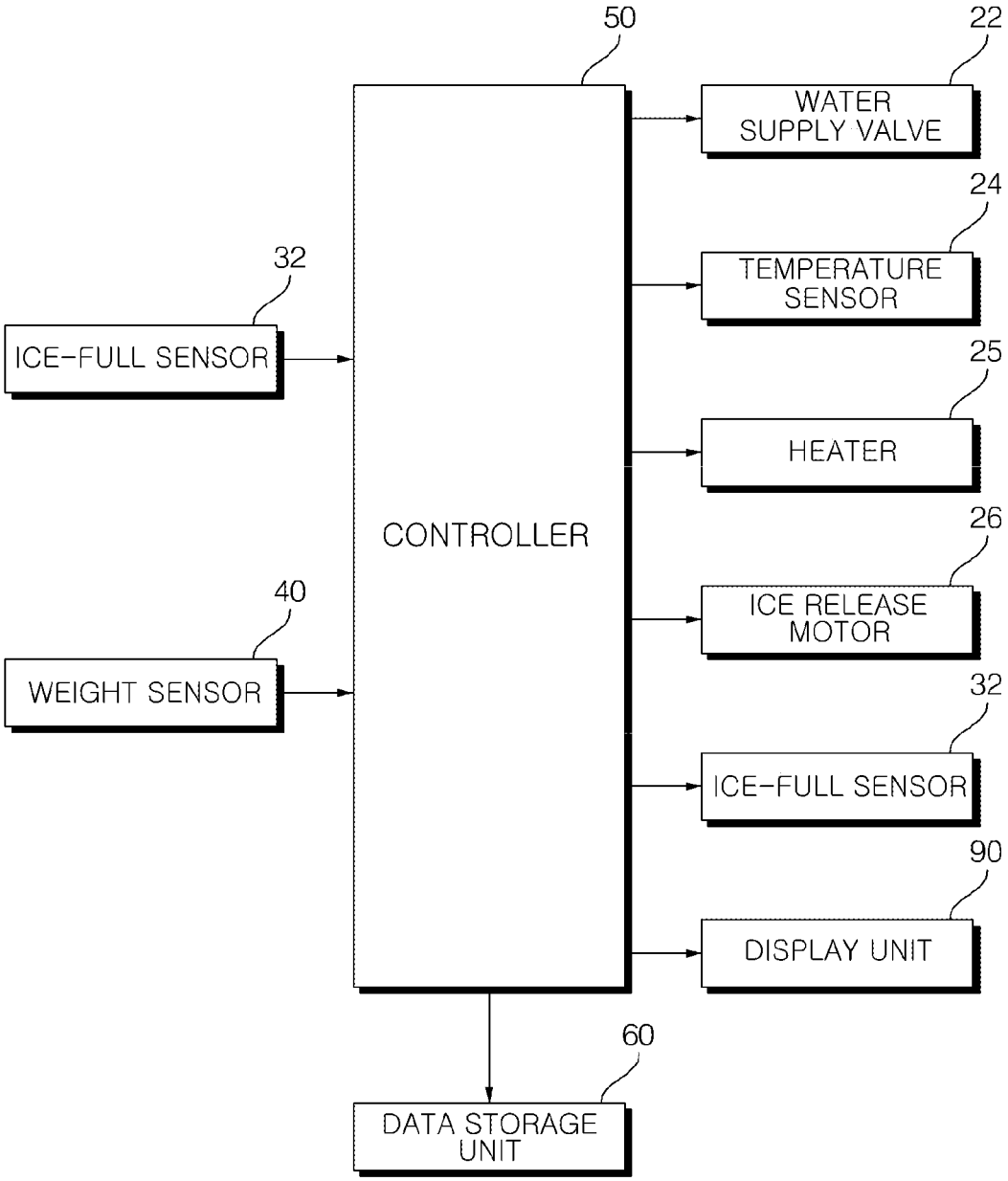
FIG. 9 is a control block diagram illustrating an example of a refrigerator.

As illustrated in FIG. 9, the refrigerator may further include a display unit 90 to display information, and the controller 50 may output an ice disposal signal to the display unit 90 when variation in the amount of ice during a set period is below a set lower limit value.

When the ice amount variation during the set period is below the set lower limit value, the display unit 90 may display information recommending that the user disposes of ice (hereinafter referred to as ice disposal information). The set lower limit value may be set to a prescribed value, for example, 0.1 kg or 0.3 kg.

The display unit 90 may display the ice disposal information simultaneously with the discharge of ice by the discharge device 70, or may display the ice disposal information instead of the discharge of ice by the discharge device 70.

The controller 50 may set a full ice determination reference value to a first reference value when the ice amount variation during the set period exceeds a first set value.

The controller 50 may set the full ice determination reference value to a second reference value, which is lower than the first reference value, when the ice amount variation during the set period is equal to or less than the first set value and exceeds a second set value, which is lower than the first set value.

The controller 50 may output an ice disposal signal to the display unit 90 when the ice amount variation during the set period is equal to or less than the second set value. The display unit 90 may outwardly display characters or symbols which guide the disposal of ice, for example, "The disposal of ice is recommended" when the ice disposal signal is output from the controller 50.

The user may perceive the ice disposal information displayed on the display unit 90, and discharge and dispose of the ice that has been stored in the ice bank 30 for a long time.

The icemaker 20 of the refrigerator may produce new and release the ice into the ice bank 30, so that fresh ice may be stored in the ice bank 30.

Figure 10:
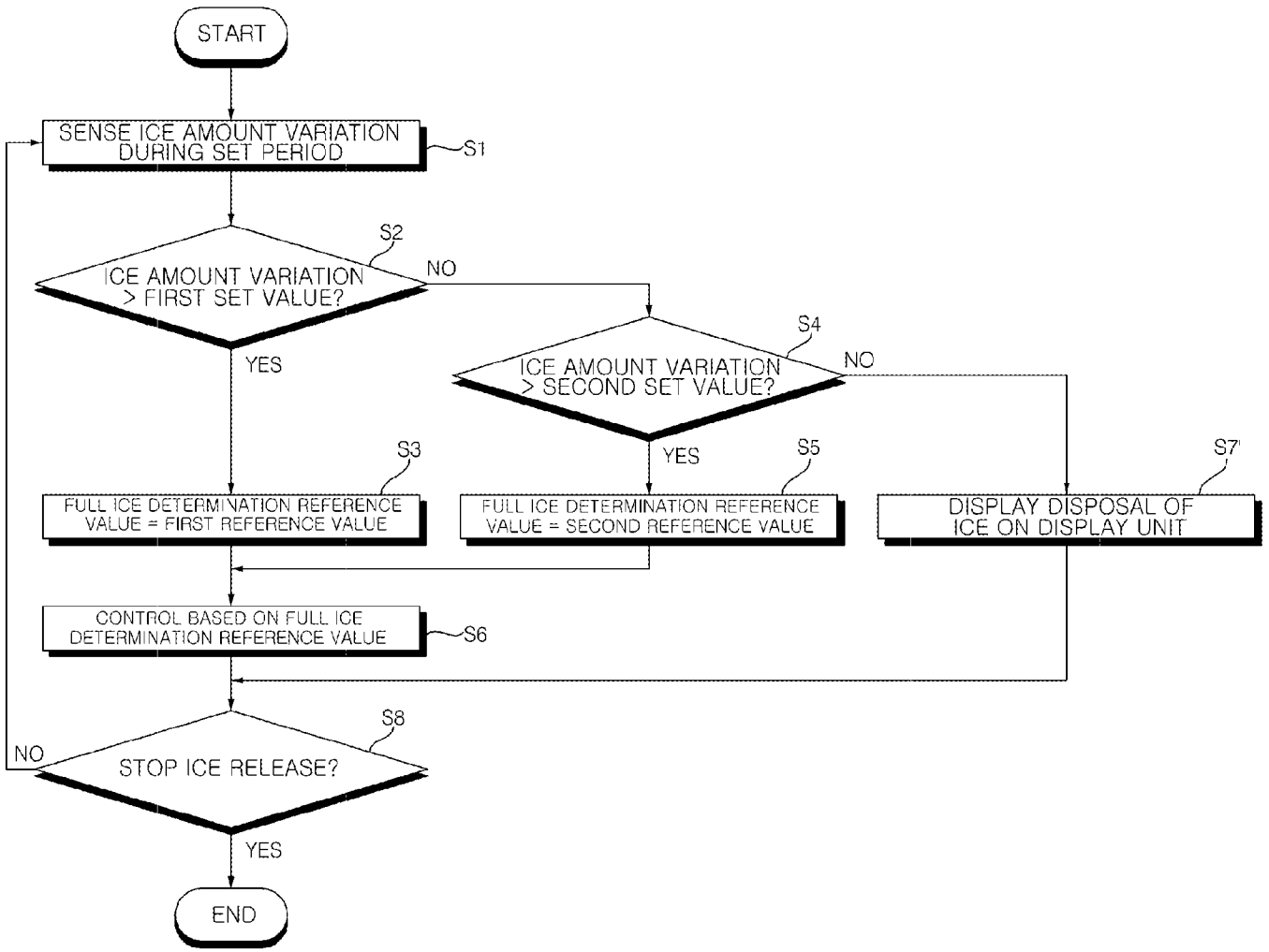
FIG. 10 is a flowchart illustrating an example of a method of operating the refrigerator.

FIG. 10 is a flowchart illustrating a method of operating the refrigerator.

The method may include a first step S1 of sensing variation in the amount of ice in the ice bank 30 during a set period, and a second step S2, S3, S4, S5, S6 and S7' of determining a full ice determination reference value for the ice bank 30 based on the ice amount variation sensed in the first step S1, or displaying the disposal of ice from the ice bank 30 on the display unit 90.

The second step S2, S3, S4, S5, S6 and S7' may include setting the full ice determination reference value to a first reference value when the ice amount variation during the set period exceeds a first set value (S2 and S3).

The second step S2, S3, S4, S5, S6 and S7' may include setting the full ice determination reference value to a second reference value, which is lower than the first reference value, when the ice amount variation during the set period is equal to or less than the first set value and exceeds a second set value, which is lower than the first set value (S2, S4 and S5).

The second step S2, S3, S4, S5, S6 and S7' may include controlling the refrigerator based on the full ice determination reference value determined as described above (S6).

The second step S2, S3, S4, S5, S6 and S7' may include displaying the disposal of ice from the ice bank 30 on the display unit 90 when the ice amount variation during the set period is equal to or less than the second set value (S2, S4 and S7').

The display unit 90 may outwardly display characters or symbols which guide the disposal of ice, for example, "The disposal of ice is recommended".

The user may perceive the ice disposal information displayed on the display unit 90, and discharge and dispose of the ice that has been stored in the ice bank 30 for a long time.

The method of operating the refrigerator may include a step S8 of no longer controlling the icemaker 20 and the water supply valve 22 and causing the icemaker 20 to stop releasing the ice into the ice bank 30 when an ice-making stop command is input via an input unit of, for example, a control panel, or when the refrigerator is powered off.

In addition, when no ice-making stop command is input, or when the refrigerator is not powered off, the method of operating the refrigerator may return to the first step S1. When the full ice determination reference value changes after the set period has elapsed, the icemaker 20 and the water supply valve 22 may be controlled based on the changed full ice determination reference value, or the disposal of ice from the ice bank 30 may be displayed on the display unit 90.

Although implementations have been described with reference to a number of illustrative implementations thereof, it should be understood that numerous other modifications and implementations can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternatives uses will also be apparent to those skilled in the art.

What is claimed is:

1. A refrigerator comprising:

an icemaker;

an ice bank that is configured to store ice released from the icemaker;

a weight sensor configured to measure a weight of the ice bank; and a controller configured to:

determine, based on weight measurements measured by the weight sensor, a variation in an amount of ice stored in the ice bank during a set time period, and adjust an ice determination reference value based on the determined variation in the amount of ice stored in the ice bank during the set time period.

2. The refrigerator according to claim 1, wherein the controller is configured to set the ice determination reference value to a first reference value based on a determination that the variation of the amount of ice during the set time period exceeds a first set value, and wherein the controller is configured to set the ice determination reference value to a second reference value, which is lower than the first reference value, based on a determination that the variation of the amount of ice during the set time period is less than the first set value.

3. The refrigerator according to claim 1, further comprising a discharge device configured to melt the ice stored in the ice bank, wherein the discharge device is configured to discharge the melted ice from the ice bank, wherein the controller is configured to set the ice determination reference value to a first reference value based on a determination that the variation of the amount of ice during the set time period exceeds a first set value, wherein the controller is configured to set the ice determination reference value to a second reference value, which is lower than the first reference value, based on a determination that the variation of the amount of ice during the set time period is less than the first set value, and exceeds a second set value, which is lower than the first set value, and wherein the controller is configured to turn on the discharge device based on a determination that the variation of the amount of ice during the set time period is less than the second set value.

4. The refrigerator according to claim 1, further comprising a discharge device configured to melt the ice stored in the ice bank, wherein the controller is configured to turn on the discharge device based on a determination that the variation of the amount of ice during the set time period is below a set lower limit value.

5. The refrigerator according to claim 4, wherein the discharge device comprises:

an ice bank heater configured to melt the ice stored in the ice bank; and a drain hose configured to discharge water from the ice bank.

6. The refrigerator according to claim 4, wherein the discharge device comprises:

a hot line configured to allow refrigerant to flow through;

a hot line valve configured to adjust the supply of refrigerant to the hot line; and a drain hose configured to discharge water from the ice bank.

7. The refrigerator according to claim 5, wherein the discharge device further comprises a drain valve installed on the drain hose.

8. The refrigerator according to claim 6, wherein the discharge device further comprises a drain valve installed on the drain hose.

9. The refrigerator according to claim 1, further comprising a display unit configured to display information, wherein the controller is configured to output an ice disposal signal to the display unit based on a determination that the variation of the amount of ice during the set time period is below a set lower limit value.

10. The refrigerator according to claim 1, further comprising a display unit configured to display information, wherein the controller is configured to set the ice determination reference value to a first reference value based on a determination that the variation of the amount of ice during the set time period exceeds a first set value, wherein the controller is configured to set the ice determination reference value to a second reference value, which is lower than the first reference value, based on a determination that the variation of the amount of ice during the set time period is less than the first set value and exceeds a second set value, which is lower than the first set value, and wherein the controller is configured to output an ice disposal signal to the display unit based on a determination that the variation of the amount of ice during the set time period is less than the second set value.

11. A refrigerator comprising:

an icemaker;

an ice bank that is configured to store ice released from the icemaker;

a weight sensor configured to measure a weight of the ice bank;

a discharge device configured to melt the ice stored in the ice bank;

a display unit configured to display information; and a controller configured to determine, based on weight measurements measured by the weight sensor, a variation in amount of ice stored in the ice bank during a set time period, wherein the controller is configured to turn on the discharge device when a determined variation in the amount of ice stored in the ice bank during a set time period is below a set lower limit value, or to output an ice disposal signal to the display unit when the variation in amount of ice during the set time period is below the set lower limit value.

12. The refrigerator according to claim 11, wherein the controller is configured to set an ice determination reference value to a first reference value when the variation of the amount of ice during the set time period exceeds a first set value, wherein the controller is configured to set the ice determination reference value to a second reference value, which is lower than the first reference value, based on a determination that the variation of the amount of ice during the set time period is less than the first set value and exceeds a second set value, which is lower than the first set value, and wherein the controller is configured to turn on the discharge device based on a determination that the variation of the ice amount during the set time period is less than the second set value.

13. The refrigerator according to claim 11, wherein the controller is configured to set an ice determination reference value to a first reference value based on a determination that the variation of the amount of ice during the set time period exceeds a first set value, wherein the controller is configured to set the ice determination reference value to a second reference value, which is lower than the first reference value, based on a determination that the variation of the amount of ice during the set time period is less than the first set value and exceeds a second set value, which is lower than the first set value, and wherein the controller is configured to output the ice disposal signal to the display unit based on a determination that the variation of the amount of ice during the set time period is less than the second set value.

14. A method of operating a refrigerator, the method comprising:

determining a variation in the amount of ice stored in an ice bank during a set time period using a weight sensor; and determining an ice determination reference value for the ice bank based on the determined variation of the amount of ice.

15. The method according to claim 14, wherein determining the ice determination reference value comprises:

setting the ice determination reference value to a first reference value based on a determination that the variation of the amount of ice during the set time period exceeds a first set value; and setting the ice determination reference value to a second reference value, which is lower than the first reference value, based on a determination that the variation of the amount of ice during the set time period is less than the first set value.

16. The method according to claim 14, further comprising melting the ice stored in the ice bank to discharge the ice outward based on the determined variation of the ice amount.

17. The method according to claim 16 further comprising:

setting the ice determination reference value to a first reference value based on a determination that the variation of the amount of ice during the set time period exceeds a first set value; and setting the ice determination reference value to a second reference value, which is lower than the first reference value, based on a determination that the variation of the amount of ice during the set time period is less than the first set value and exceeds a second set value, which is lower than the first set value, and wherein the melting includes turning on a discharge device when the variation of the amount of ice during the set time period is less than the second set value.

18. The method according to claim 14, further comprising displaying the disposal of ice from the ice bank on a display unit based on the determined variation of the amount of ice.

19. The method according to claim 18, further comprising:

setting the ice determination reference value to a first reference value based on a determination that the variation of the amount of ice during the set time period exceeds a first set value; and setting the ice determination reference value to a second reference value, which is lower than the first reference value, based on a determination that the variation of the amount of ice during the set time period is less than the first set value and exceeds a second set value, which is lower than the first set value, and wherein displaying the disposal of ice from the ice bank on the display unit is based on a determination that the variation of the amount of ice during the set time period is less than the second set value.

* * * * *